US005238134A

United States Patent [19]

Knapp

[11] Patent Number: 5,238,134

[45] Date of Patent: Aug. 24, 1993

[54] LIMITED-REUSE TAMPER-EVIDENT CONTAINER

[75] Inventor: Donald L. Knapp, Pasadena, Md.

[73] Assignee: The United States of America as represented by the Director of the National Security Agency, Washington, D.C.

[21] Appl. No.: 932,539

[22] Filed: Aug. 20, 1992

[51] Int. Cl.[5] ..... B65D 41/32

[52] U.S. Cl. ..... 220/266; 220/265; 220/4.21; 215/253

[58] Field of Search ..... 220/4.21, 265, 266; 215/250, 253; 229/125.27, 125.28

[56] References Cited

U.S. PATENT DOCUMENTS

| | | | |
|---|---|---|---|
| 2,579,354 | 12/1951 | Zelt | 229/125.28 X |
| 2,884,123 | 4/1959 | Dann et al. | 206/43 |
| 3,343,660 | 9/1967 | Bailey | 229/125.27 X |
| 3,645,758 | 2/1972 | MacManus | 220/403 X |
| 4,361,250 | 11/1982 | Foster | 220/266 |
| 4,406,426 | 9/1983 | Crandall | 242/197 |
| 4,462,505 | 7/1984 | Paradis | 220/266 |
| 4,474,305 | 10/1984 | Marco | 220/307 |
| 4,487,324 | 12/1984 | Ostrowsky | 215/253 |
| 4,493,433 | 1/1985 | Sideri et al. | 220/306 |
| 4,610,371 | 9/1986 | Korkiewicz | 220/266 |
| 4,658,980 | 4/1987 | Lindstrom | 220/214 |
| 4,709,823 | 12/1987 | Beck et al. | 215/235 |
| 4,711,363 | 12/1987 | Marino | 220/266 |
| 4,711,372 | 12/1987 | Gach | 222/23 |
| 4,724,977 | 2/1988 | Cleevely et al. | 220/258 |
| 4,757,898 | 7/1988 | Klein | 206/459 |
| 4,763,732 | 8/1988 | Neal | 220/266 X |
| 4,793,503 | 12/1988 | Towns et al. | 215/250 |
| 4,793,504 | 12/1988 | Towns et al. | 215/250 |
| 4,821,910 | 4/1989 | Poirer | 220/266 |
| 4,934,554 | 6/1990 | Edwards | 220/266 |
| 4,934,557 | 6/1990 | Smith | 220/276 |
| 4,942,974 | 7/1990 | Larrison | 220/214 |
| 4,974,735 | 12/1990 | Newell et al. | 215/253 |
| 5,133,470 | 7/1992 | Abrams et al. | 215/250 |

FOREIGN PATENT DOCUMENTS

| | | | |
|---|---|---|---|
| 142870 | 5/1985 | European Pat. Off. | 229/125.28 |

*Primary Examiner*—Allan N. Shoap
*Assistant Examiner*—Stephen Cronin

[57] ABSTRACT

A tamper-evident container is disclosed that can be reused a limited number of times with the tamper-evident feature for secure storage or transport of material. The container is made up of a base and a lid. The base has a hollow interior for holding material and an open top. The base also has a number of platform-like holders, each with a hole, that project perpendicular to and inwardly from the interior walls of the base. The holders are used in attaching the lid to the base. The lid is the same shape as the base (i.e., multisided, hexagonal, or circular). The lid contains frangible elements which outnumber the holders in the base. Each frangible element is made up of a shaft tipped with a cone. Frangibility of the element is achieved by dividing it into quadrants and scoring the base. Each element extends downward from the interior-top of the lid. A subset of the frangible elements align with the holders in the base. The container is closed when a subset of frangible elements engage with the holders. The lid and the base each have a built-in handle. The container is opened by pulling on the handles to separate the lid from the base. The frangible elements are broken when the container is opened. Tampering is defined as unauthorized opening. The container can be reused with this tamper-evident feature by rotating the lid with respect to the base so that another subset of unbroken frangible-elements align with the holders so that the container upon engagement of the new subset.

13 Claims, 5 Drawing Sheets

LIMITED-REUSE TAMPER-EVIDENT CONTAINER

BACKGROUND OF THE INVENTION

Field of Invention

This invention relates in general to packaging and more particularly to a container that provides visual evidence that a container has been opened a limited number of times.

Description of Related Art

A wide variety of containers have been designed to provide evidence of package tampering. Many of these devices were invented to prevent problems associated with an initial unauthorized entry such as the purchase by unsuspecting customers of products that have been tampered with. These previous inventions have not addressed the problem of subsequent tampering of a container as the present invention does.

In U.S. Pat. No. 4,711,372, entitled "Tamper Indicating Closure", a flip-top cap for a dispensing container was described that contained a pin that broke upon the first opening of the cap. The broken pin would be visible to subsequent users or purchasers of the product. No capability for tamper-indication after the first use was disclosed.

In U.S. Pat. No. 4,493,433, entitled "Self-Locking Pilfer Proof Tamper Evident Container", a device was described for the retention of items, such as apartment keys by the manager of an apartment complex, so that it would be evident that someone had gained access to the item contained therein. Such a device would give the apartment dweller confidence that the possibility of access to their apartment by others could be monitored. This device has internally-contained pins that engage upon closure of the container and break upon opening of the container. This device can only be used one time with the tamper-evident feature. It does not provide the capability for multiple use.

In U.S. Pat. No. 4,462,505, entitled "Resealable Tamper-Proof Closures", a device was described that does away with the need to use shrink-wrap for indicating tamper by integrally molding the cap to the housing. To open the closure, the cap it broken away from the housing. The cap can then be used to reseal the closure. This device does not indicate whether subsequent openings have occurred.

In U.S. pat. No. 2,884,123, entitled "Tamper-Proof Injection Cartridge Housing", a multicompartmented device was described that uses optically-clear windows to allow users to view the contents of the device prior to opening the compartment of interest. This device provides a visual indication of the initial opening but not for subsequent openings.

These prior art inventions have addressed the problem of initial tampering of a product but have not addressed the problem of subsequent tampering. The present invention provides for a device that indicates initial opening (or tampering) and a limited number of subsequent openings (or tamperings).

SUMMARY OF THE INVENTION

It is an object of this invention to provide a tamper-evident container assembly for the secure transport of items of interest.

It is an another object of this invention to provide a reusable tamper-evident container assembly for the secure transport of items of interest.

It is another object of this invention to provide a tamper-evident container assembly for the secure transport of items of interest which is resistant to sophisticated tamper efforts.

It is an object of this invention to provide a tamper-evident container assembly for the secure storage of items of interest.

It is another object of this invention to provide a reusable tamper-evident container assembly for the secure storage of items of interest.

It is another object of this invention to provide a tamper-evident container assembly for the secure storage of items of interest which is resistant to sophisticated tamper efforts.

To accomplish the objects of the present invention, a limited-reuse tamper-evident container assembly is provided which is constructed of a mechanically interlocking lid and base. The base which is an open-top box-like structure is overlapped by the lid which makes the contents inaccessible unless the container is opened. The container is opened by separating the lid from the base using handles which are built into the lid and base.

The interlock between the lid and base is provided by frangible tamper-indicating elements that engage upon closure of the container and break upon opening of the container. The initial number of tamper-indicating elements exceeds the number needed to close the container. Upon the opening (or the unauthorized tampering) of the container the tamper-indicating elements used to close the container are broken. These broken elements indicate to the user that the container was opened or tampered with.

The lid of the container can then be repositioned so that a subset of the unbroken tamper-indicating elements can be used in order to re-close the container so that subsequent opening (or tampering) can be detected. The user must record which tamper-indicating elements were used to re-close the container in order to determine if a subsequent opening (or tampering) of the container occurred. The tamper-evident container can be reused until all of the tamper-indicating elements are broken. The lid and the base can be made using marbalized plastic so that substitution of a lid can be detected.

The maximum number of reuses of the container is determined by the number of tamper-indicating elements, the number of tamper-indicating elements needed to close the container, and the shape of the container. For multisided containers, the maximum number of tamper-indicating uses maximally equal the number of sides of the container. This is so because the number of sides determines the maximum number of lid repositions possible. For a circular container, the maximum number of tamper-indicating uses is limited only by the number of available tamper-indicating element subsets.

DESCRIPTION OF PREFERRED EMBODIMENTS

Many variations of tamper-evident packages typically indicated by the deformation or destruction of an element such as a pin within a container upon initial opening of the container. After the container is opened, the ability to indicate tampering due to subsequent openings is lost. Containers that only indicate initial openings are generally adequate for protecting consumers from purchasing products that have been tampered with but are inadequate for indicating subsequent openings (or tamperings).

The present invention describes a container that not only indicates initial opening (or tampering) of a container but also indicates that a container was subsequently opened (or tampered with) for a limited number of subsequent openings (or tamperings).

The gist of the present invention is that the initial number of tamper-indicating elements exceeds the number needed to close the container. Upon the opening (or the unauthorized tampering) of the container the tamper-indicating elements used to close the container are broken. These broken elements indicate to the user that the container was opened or tampered with. The lid of the container can then be repositioned so that a subset of the unbroken tamper-indicating elements can be used in order to re-close the container so that subsequent tampering can be detected. The user must record which tamper-indicating elements were used to re-close the container in order to determine if a subsequent opening (or tampering) occurred. The container can be re-closed with the ability to indicate tampering until all of the tamper-indicating elements are broken. The maximum number of reuses of the container is determined by the number of tamper-indicating elements, the number of tamper-indicating elements needed to close the container, and the shape of the container. For multisided containers, the maximum number of tamper-indicating uses maximally equal the number of sides of the container. This is so because the number of sides of the container determines the maximum number of lid repositions possible. For a circular container, the maximum number of tamper-indicating uses is limited only by the number of available tamper-indicating element subsets.

A user must record which tamper-indicating elements were used to close the container in order to detect when tamperers re-close the container using the remaining unbroken tamper-indicating elements.

Figure 1:
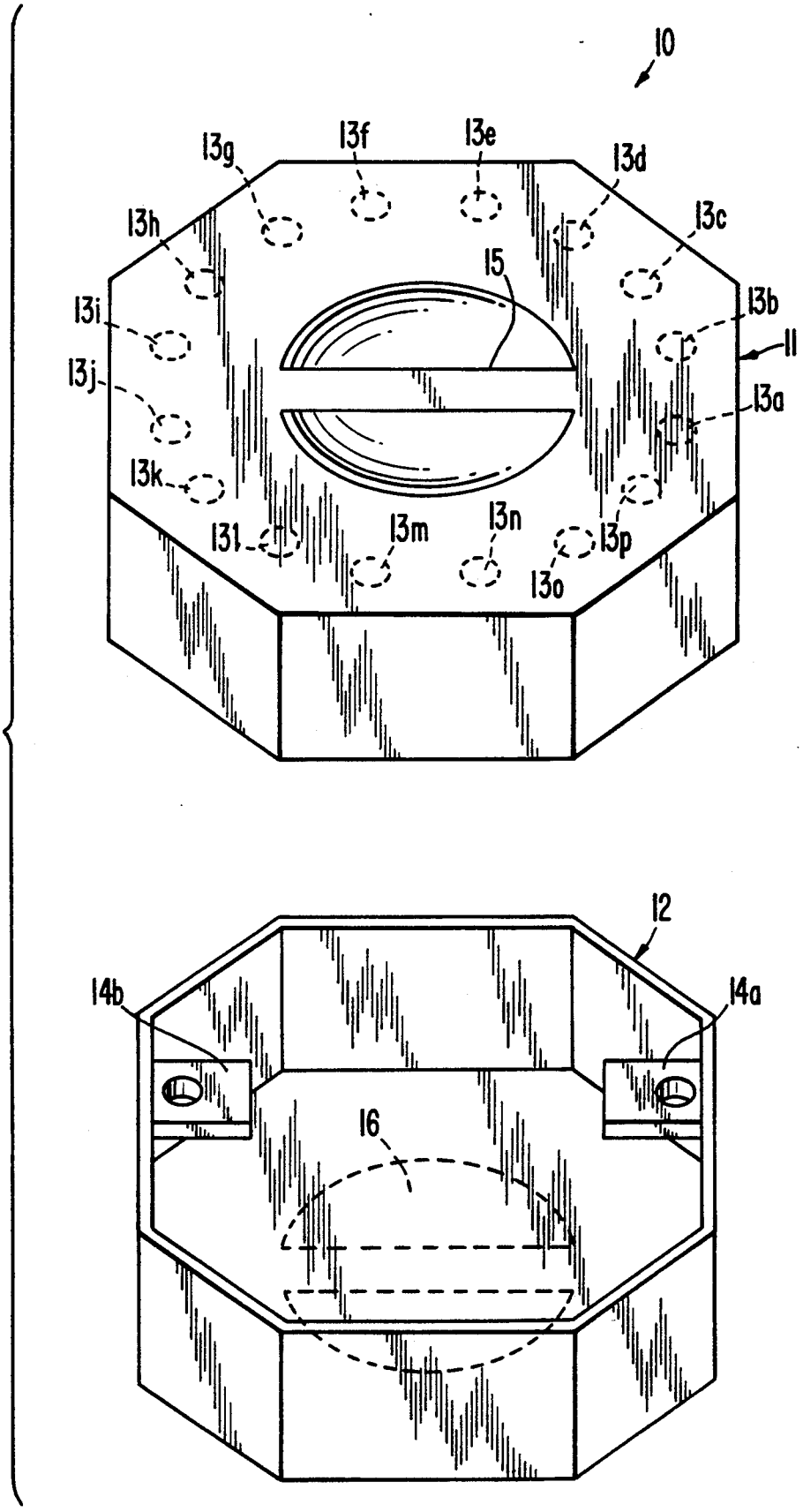
FIG. 1 is an exploded perspective-view of the container.

FIG. 1 shows an exploded perspective-view of one possible configuration of a reusable tamper-evident container assembly 10. The container 10 is made up of a lid 11 and a base 12. The container 10 can be made of many different materials but is preferably constructed out of either optically clear plastic or opaque plastic.

The list of plastics include but is not limited to butyrate, acetate, nylon, lucite, and plexiglass. The use of optically clear plastic gives the user the ability to visually determine without opening the container 10 that the container 10 has been tampered with. The use of opaque materials gives the user the ability to prevent viewing of the contents of the container 10. The container 10 may be formed in many ways such as injection molding or thermoforming.

The plastic used may also be marbalized. Marbalization is a process that creates unique patterns in the material of an item. These patterns are visible and difficult to duplicate. Marbalization of the lid 11 and base 12 can be used to pair the lid 11 to the base 12 so that substitution of one of these items can be detected.

The lid 11 mechanically interlocks with the base 12. The interlock between the lid 11 and the base 12 is accomplished by having a subset of tamper-indicating frangible elements 13*a*—13*p* which are integrally contained in the lid 11 engage with holders 14*a*–14*b* which are integrally contained in the base 12. The tamper evident feature is provided by these frangible elements 13*a*–13*b* which break upon opening or tampering of the container 10. When the container 10 is opened and an improper subset of frangible tamper-indicating elements 13*a*–13*p* is broken, the user is alerted to the fact that tampering has taken place.

The base 12 is box-like with an open top. Many different types of products can be stored in the base 12. The base 12 has a flat bottom and sidewalls that extend perpendicularly to and upward from the bottom. FIG. 1 depicts the base 12 as a hexagonal open-top box-like structure. This is only one of many possible embodiments of the base 12. The number of sides of the base 12 is one factor that helps determine the maximum number of tamper-indicating uses that can be derived from the container 10. Determination of the exact number of tamper-evident uses of the container 10 will become evident after the tamper-indicating elements 13*a*–13*p* are described.

The holders 14*a*–14*b* are integral to the walls of the base 12 and extend interiorly from and perpendicular to the walls of the base 12. Each square-nut-like holder 14*a*–14*b* has a hole in it so that subset of the tamper-indicating frangible elements 13*a*–13*p* (initially 13*b* and 13*i*) contained within the base 12 in order to with the holders 14*a*–14*b* contained within the base 12 in order to close the container 10. One possible embodiment depicted in FIG. 1 shows the use of only two holders 14*a*–14*b* which were placed directly across from one another. Different numbers of holders and different placements of the holders are possible. The embodiment of FIG. 1 which depicts sixteen tamper-indicating frangible elements 13*a*–13*p* and two holders 14*a*–14*b* allows for eight tamper-indicating uses of the container. The configuration of FIG. 1 only requires two tamper-indicating elements to be used to close the container 10. Eight lid 11 positions are possible so that the tamper-indicating elements 13*a*–13*p* can be aligned with the holders 14*a*–14*b* in order to close the container 10.

Tamper-indicating reuse of the container 10 after initial opening of the container only requires a rotation of the lid 11 in order to align another subset of unbroken tamper-indicating frangible elements 13*a*–13*p* (less 13*b* and 13*i* which were broken on the initial opening) with the holders 14*a*–14*b*. The maximum number of subsets of tamper-indicating frangible elements 13*a*–13*p* that can be aligned with the holders 14*a*–14*b* in order to close the container 10 is the maximum number of tamper-evident uses that can be derived from the container 10.

The shape of the lid 11 is the same as the base 12 except for the fact that the lid 11 has a diameter slightly larger than the base 12 so that the interior walls of the lid 11 fit snugly over the exterior walls of the base 12. This overlapping design makes the contents of the container 10 inaccessible to would-be tamperers except by opening the container 10.

The base 12 has a built-in handle 16. The handle 16 is located at the exterior-bottom of the base 12. Material in the exterior-bottom of the base 12 is removed to form the built-in handle 16. Enough material is removed from beneath and along both sides of the handle 16 to allow a person to firmly grasp the handle 16. Force is applied to the handle 16 in order to open the container 10 by separating the lid 11 from the base 12. When the container 10 is opened the two tamper-indicating elements (initially **13*b* and 13*i*) which were engaged with the holders 14*a*–14*b* are broken. These broken elements (initially 13*b* and 13*i*) indicate that the container 10 was opened or tampered with. The lid 11 also has a built-in handle 15 which is located in the exterior-top of the lid 11. This handle 15 is identical in shape and function to the handle 16 contained within the base 12**.

Figure 2:
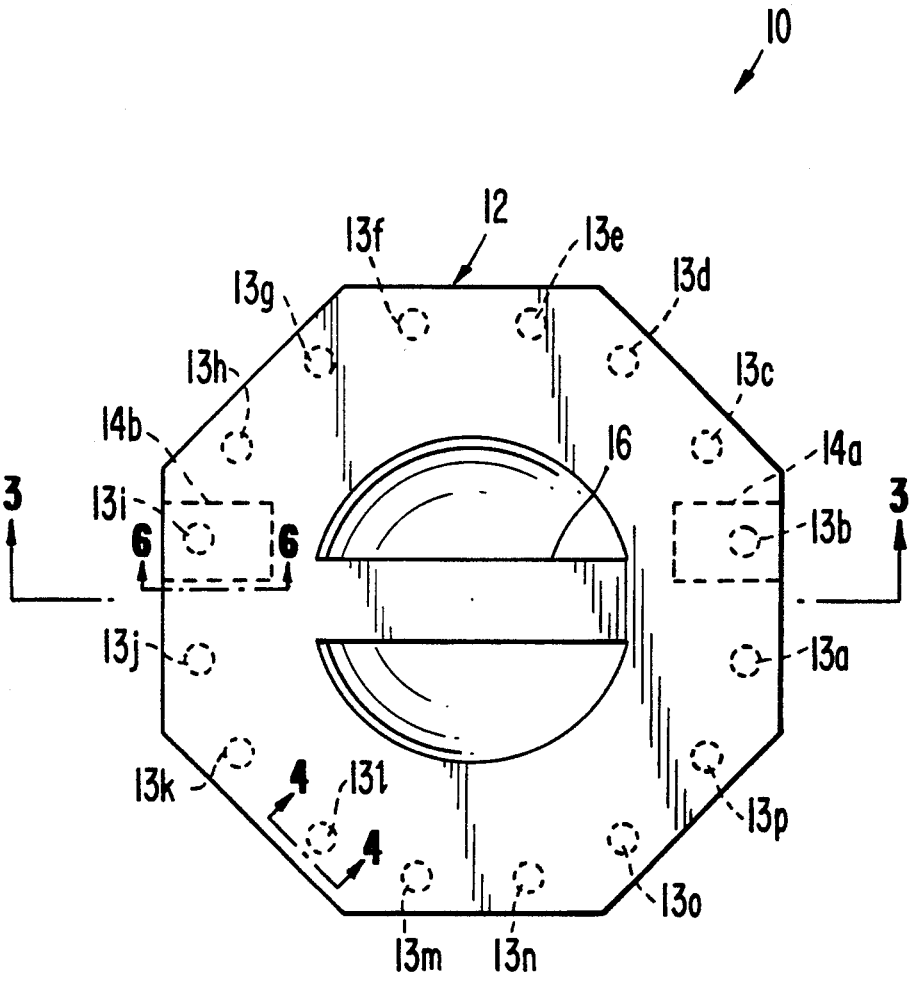
FIG. 2 is a bottom view of the container.

FIG. 2 shows the bottom view of the container 10. Interlocking the lid 11 to the base 12 requires that a subset of the tamper-indicating elements **13*a*–13*p* contained in the lid 11 align with the holders 14*a*–14*b* contained in the base 12. Cross-sectional lines 3—3, 4—4, and 6—6 will be used to show respectively the cross-section of the container 10 in FIG. 3, the cross-section of the tamper-indicating element in FIG. 4, and the sequence of events involved in closing and opening the container 10 in FIGS. 6, 7, and 8**.

Figure 3:
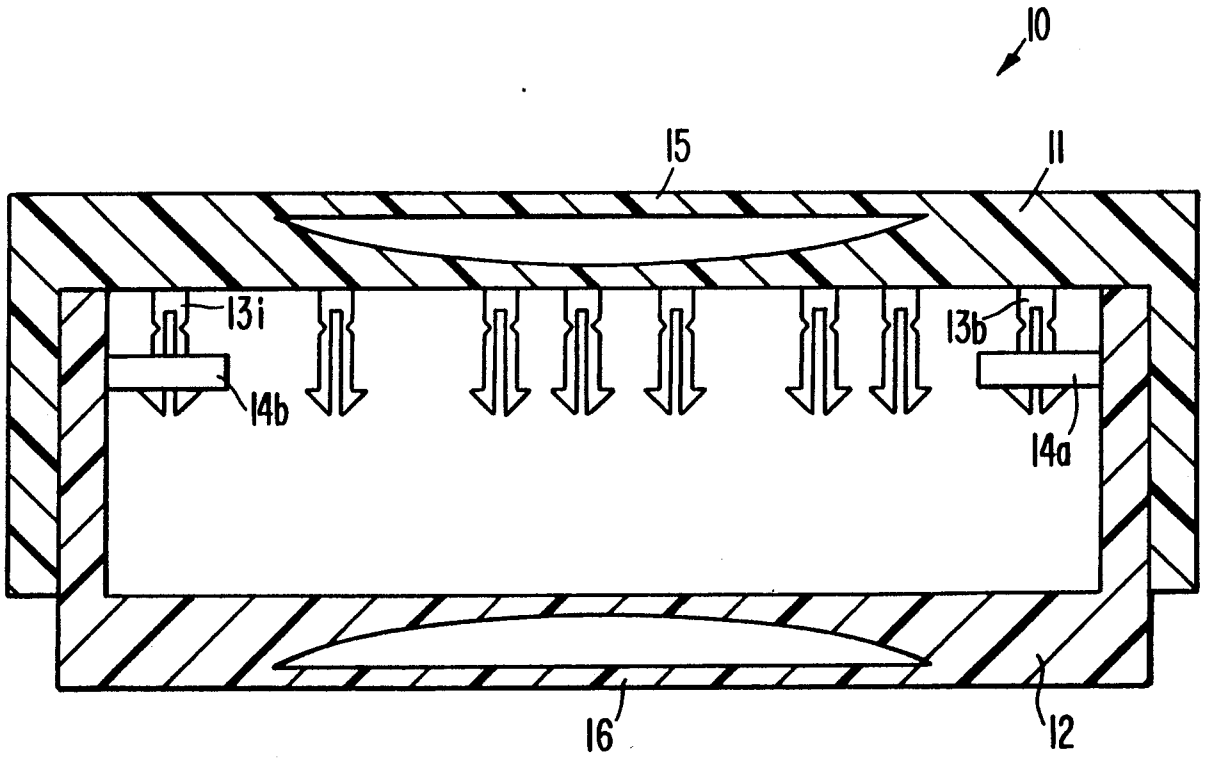
FIG. 3 is a cross-sectional view of the container as seen along line 3—3 of FIG. 2.

FIG. 3 is a cross-sectional view of the container 10 along the line 3—3 of FIG. 2. The size of the storage portion of the container 10 is defined by the interior cavity of the base 12. The walls of the base 12 are enclosed by the walls of the lid 11. The lid 11 is mechanically interlocked to the base 12 when a subset of the tamper-indicating elements (initially **13*b*–13*i*) engage with the holders 14*a*–14*b* of the base 12. Tamper-indicating elements 13*a*–13*p* circumscribe the lid 11 just inside its perimeter. These frangible elements 13*a*–13*p* extend downward from the interior-top of the lid 11. A subset of these elements 13*a*–13*p*, (i.e., two as shown in FIG. 1) are brought into securement with the holders 14*a*–14*b* in base 12. Alternate embodiments may include one or more holders which may be placed in other locations the ones described herein. The overlap of the walls of the lid 11 with the walls of the base 12 prevents access to the contents of the container 10 if the container 10 is not opened. The container 10 is opened by grasping the built-in handle 15 of the lid 11 and the built-in handle 16 of the base 12 and pulling the lid 11 and base 12 apart. Opening the container 10 in this manner results in the breaking of the subset of tamper-indicating elements (initially 13*b* and 13*i*) which secure the lid 11 to base 12. Unauthorized breaking of these elements (initially 13*b* and 13*i*) indicate that the container 10 was tampered with. By repositioning the lid 11, another subset of two unbroken tamper-indicating elements can be used to close the container 10 so that a subsequent opening or tampering can be detected. The user must record which tamper-indicating elements 13*a*–13*p*were used to re-close the container 10 in order to prevent a re-closure of the container 10** by the tamperer from going undetected.

Figure 4:
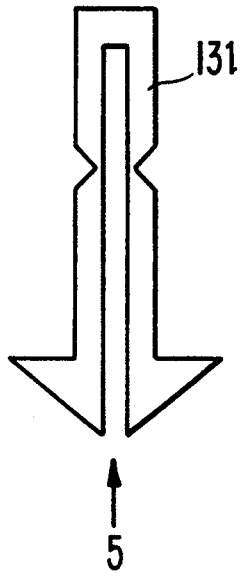
FIG. 4 is a partial side view of a tamper-evident element as seen along line 4—4 of FIG. 2.
Figure 5:
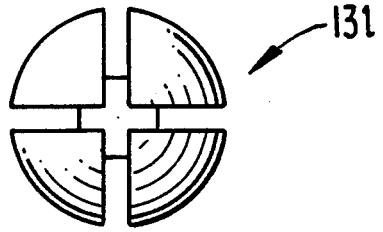
FIG. 5 is a plain view of a tamper-evident element showing its construction.

FIG. 4 is a partial cross-sectional view of a tamper-indicating element 131 looking along the cross-sectional line of 4—4 of FIG. 2. Each tamper-indicating element **13*a*–13*p* ia a cylindrical shaft with a cone on the end which is not integrally attached to the lid 11. The base of the shaft is scored in order to make each tamper-indicating element 13*a*–13*p* frangible. The shaft and the cone are divided into quadrants so that the force required to pull the lid 11 away from the base 12 is enough to break these elements 13*a*–13*p*. FIG. 5 is a view of a tamper-indicating element 131** looking down upon the cone showing that the tamper-indicating element is divided into quadrants.

Figure 6:
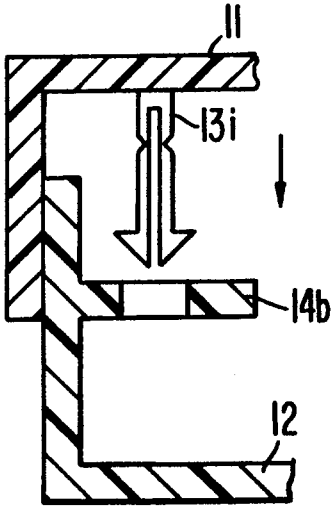
FIG. 6 is a partial side view of a tamper-evident element taken along line 6—6 of FIG. 2 showing a tamper-evident element prior to engagement with a holder.

FIG. 6 is a partial cross-sectional view of the container 10 along the cross-sectional line 6—6 of FIG. 2. FIG. 6 shows the container 10 just prior to being closed. The tamper-indicating element **13*i* of the lid 11 has not yet engaged with the holder 14*b* of the base 12**.

Figure 7:
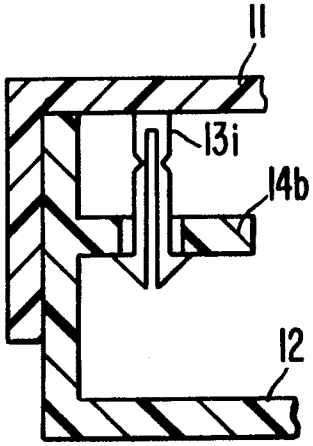
FIG. 7 is a partial side view of a tamper-evident element taken along line 6—6 of FIG. 2 showing a tamper-evident element engaged with a holder.

FIG. 7 is a partial cross-sectional view of the container 10 along the cross-sectional line 6—6 of FIG. 2. FIG. 7 shows the container 10 when it is in the closed state. The tamper-indicating element **13*i* of the lid 11 is engaged with the holder 14*b* of the base 12**.

Figure 8:
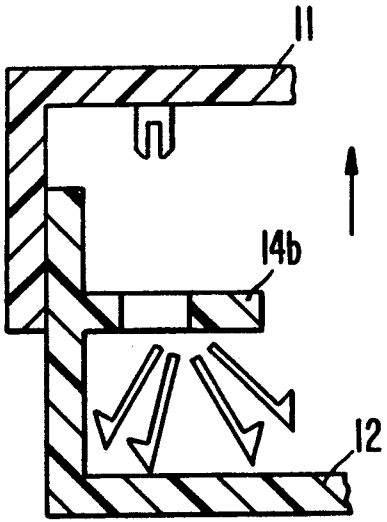
FIG. 8 is a partial side view of a broken tamper-evident element taken along line 6—6 of FIG. 2 showing a tamper-evident element after disengagement from a holder.

FIG. 8 is a partial cross-sectional view of the container 10 along the cross-sectional line 6—6 of FIG. 2. FIG. 8 shows the container 10 just after being opened (or tampered with). The tamper-indicating element **13*i* of the lid 11 has been disengaged from the holder 14*b* of the base 12 resulting in the element 131** being broken along the score line into four pieces.

The limited reuse tamper-evident container of the present invention may take a wide variety of forms and be constructed using a variety of materials and processes while remaining within the scope of the present invention which is only limited by the appended claims.

What is claimed is:

1. A limited-reuse tamper-evident container assembly or indicating whether said assembly has been opened a limited number of times comprising:

(a) a base for holding materials contained therein including a surface, side walls extending orthogonally from said surface, an open top opposite said surface, and at least one platform-like structure extending inwardly from said side walls, said at least one platform-like structure being situated between said surface and said open top, each of said at least one platform-like structure includes a hole; and (b) a removable lid applicable to said base for closing said container assembly including a surface, side walls extending orthogonally from said surface, an open bottom opposite said surface that fits snugly over said side walls of said base, and a plurality of frangible elements extending from said surface toward said hole in said at least one platform-like structure of said base wherein one of said frangible elements engages with each said at least one platform-like structure to secure said lid to said base and provide evidence of removal of said lid from said base which results in the destruction of said engaged frangible element, unused and unbroken frangible elements provide a limited number of tamper-evident reuses of said container assembly by allowing the lid to be repositioned with respect to said base in order to engage another of said unbroken frangible elements, each of said frangible elements includes a quartered stem integrally molded with said surface of said lid and a quartered cone at a free end of said stem, said stem includes a weakened point of reduced cross section disposed at an end of said stem opposite said free end thereof.

2. The limited-reuse tamper-evident container assembly of claim 3, wherein:

(a) said base includes a handle extending outwardly from said surface of said base for providing mechanical support for pulling said base away from said lid; and (b) said lid includes a handle extending outwardly from said surface of said lid for providing mechanical support for pulling said lid away from said base, such separation causes the destruction of said engaged frangible-elements and provides evidence of tampering.

3. The limited-reuse tamper-evident container assembly of claim 2, wherein:

(a) said base includes at least three side walls; and (b) said lid includes an equal number of side walls as does said base, wherein the number of side walls determines the maximum number of lid orientations and therefore the maximum number of tamper-evident uses that can be obtained with said container assembly.

4. The limited-reuse tamper-evident container assembly of claim 3, wherein:

(a) said base includes eight side walls and two platform-like structures, said platform-like structures being situated in-line with each other and on opposite side walls of said base; and (b) said lid includes eight side walls and sixteen frangible elements, said frangible elements are situated so that there are two frangible elements located along each side wall of said lid so that said frangible elements align with said platform-like structures of said base in order to obtain eight tamper-evident uses of said container assembly.

5. The limited-reuse tamper-evident container assembly of claim 4, wherein said base and said lid are made of optically-clear plastic for maximum visual recognition of tampering.

6. The limited-reuse tamper-evident container assembly of claim 5, wherein said plastic is marbalized to provide unique identification of said container.

7. The limited-reuse tamper-evident container assembly of claim 4, wherein said base and aid lid are made of opaque plastic for preventing visual access to the contents of said container.

8. The limited-reuse tamper-evident container assembly of claim 7, wherein said plastic is marbalized to provide unique identification of said container.

9. The limited-reuse tamper-evident container assembly of claim 2, wherein:

(a) said base is circular; and (b) said lid is circular, wherein he number of frangible-elements determines the maximum number of lid orientations and therefore the maximum number of tamper-evident uses that can be obtained from said container.

10. The limited-reuse tamper-evident container assembly of claim 9, wherein said base and said lid are made of optically-clear plastic for maximum visual recognition of tampering.

11. The limited-reuse tamper-evident container assembly of claim 10, wherein said plastic is marbalized to provide unique identification of said container.

12. The limited-reuse tamper-evident container assembly of claim 9, wherein said base and said lid are made of opaque plastic for preventing visual access to the contents of said container.

13. The limited-reuse tamper-evident container assembly of claim 12, wherein said plastic is marbalized to provide unique identification of said container.

* * * * *